US005153059A

United States Patent [19]

Mizutani

[11] Patent Number: 5,153,059

[45] Date of Patent: Oct. 6, 1992

[54] INK RIBBON TO BE USED FOR PRODUCING A DRY TRANSFER MATERIAL

[75] Inventor: Tadashi Mizutani, Nagoya, Japan

[73] Assignee: Brother Kogyo Kabushiki Kaisha, Nagoya, Japan

[21] Appl. No.: 742,433

[22] Filed: Aug. 8, 1991

[30] Foreign Application Priority Data

Aug. 20, 1990 [JP] Japan ..... 2-218714

[51] Int. Cl.[5] ..... B41M 5/165

[52] U.S. Cl. ..... 428/3215; 428/195; 428/336; 428/914

[58] Field of Search ..... 428/40, 42, 73, 132, 428/321.3, 336, 906, 914, 195

[56] References Cited

U.S. PATENT DOCUMENTS 4,652,486 3/1987 Tasaka et al. ..... 428/321
4,870,427 9/1989 Kobayashi et al. ..... 346/1

FOREIGN PATENT DOCUMENTS 63-251287 10/1988 Japan .

*Primary Examiner*—Bruce H. Hess
*Assistant Examiner*—W. Krynski
*Attorney, Agent, or Firm*—Oliff & Berridge

[57] ABSTRACT

An ink ribbon for producing a dry transfer material having microcapsule encapsulated mold releasing agent coated on a ribbon substrate so that the mold releasing agent is nonfunctional until the microcapsules are ruptured by pressure. The microcapsules containing the mold releasing agent make an ink layer separate from a transfer sheet more completely and easily upon their rupture.

15 Claims, 4 Drawing Sheets

Fig.4(A)

| | TIME(hr.) | | |
|---|---|---|---|
| | 0~240(hr.) | 240~480(hr.) | 480~720(hr.) |
| SAMPLE 1 | 0/100 | 0/100 | 0/100 |

Fig.4(B)

| | TIME(hr.) | | |
|---|---|---|---|
| | 0~240(hr.) | 240~480(hr.) | 480~720(hr.) |
| CONVENTIONAL SAMPLE | 10/100 | 60/100 | 91/100 |

INK RIBBON TO BE USED FOR PRODUCING A DRY TRANSFER MATERIAL

BACKGROUND OF THE INVENTION

1. Field of the Invention

This invention relates to an ink ribbon to be used for producing a dry transfer material and, more particularly, relates to an ink ribbon which can produce a dry transfer image on a transfer sheet that may be subsequently transferred to a receiving material.

2. Description of Related Art

Recently, a device for producing dry transfer material which comprises a transfer sheet for dry transfer material and a ribbon cartridge in which an ink ribbon for producing the dry transfer material is stored has been developed and used widely. As such a device, Tape Printer "P-touch" manufactured by Brother industries, Ltd. is well known. A thermal head is installed in the device for producing the dry transfer material. The ink ribbon is brought in contact with a transfer sheet by the thermal head and a number of heating elements, aligned on the thermal head, are caused to generate heat according to electrical signals whereby the ink on the ribbon in contact with the heating elements is heated through a base sheet of the ribbon and fused onto the transfer sheet.

Further, as described in U.S. Pat. No. 4,870,427 (corresponding to Japanese Laid-Open Patent Publication No. 63-128990 and Japanese Laid-Open Patent Publication No. 63-128991), the ink ribbon for producing dry transfer material comprises an ink layer which is arranged on a film-like ribbon substrate and contains a resin having pressure-sensitive adhesive property and a coloring matter therein, and a control layer which is arranged on the ink layer and contains a resin having a thermo-sensitive adhesive property.

Another ink ribbon for producing dry transfer material comprises, as described in Japanese Laid-Open Patent Publication No. 63-251287, a layer arranged on a film-like ribbon substrate that contains a resin having pressure-sensitive adhesive property and an ink layer pressure-sensitive adhesive property and an ink layer which is arranged on the layer and contains a resin having thermal-sensitive adhesive property, with a coloring matter therein.

The user installs a ribbon cartridge, in which an ink ribbon for producing dry transfer material is stored, in the device for producing the dry transfer material. The user then inputs the characters or figures, by means of a key board or other external data source, the user wants recorded on the dry transfer material. Following the data input, the heat-generating elements of the device corresponding to characters or figures to be recorded are heated according to the input character and figure data. The ink from the ink ribbon for producing the dry transfer material is transferred to a transfer sheet formed by a transparent resin sheet, whereby the dry transfer material, that is the transferred image consisting of characters and figures formed on the transfer sheet, is produced. To use the dry transfer material, the user presses the dry transfer material against a desired surface and transfers the ink image to the surface with the application of pressure to a side opposite the ink image.

However, with current transfer materials, there is a problem that the quality of the transferred image is not good as produced by transferring from the dry transfer material to the receiving surface.

To transfer the known dry transfer material, the user must place the side of the transfer sheet having the ink transfer image in contact with the surface of the receiving material, such as paper, plastic, metal, or wood, and then the user must rub, for a long period of time, the back side of the transfer sheet.

However, it was difficult to obtain a high quality transferred image because collapse and spreading of the ink transferred image results if the transfer sheet is insufficiently fixed with respect to the receiving material surface and the transfer sheet shifts position during the rubbing and transfer.

The inventors of the present invention studied the problem and found the reason why the user had to keep rubbing the transfer sheet for such a long period of time was because the pressure-sensitive adhesive property of the resin, such as described in EXAMPLE 2 of column 18 of U.S. Pat. No. 4,870,427, was weak.

OBJECTS AND SUMMARY OF THE INVENTION

It is an object of the present invention to overcome the above described drawbacks and disadvantages of known dry transfer materials and to provide an ink ribbon for producing a dry transfer material capable of easily transferring an ink transfer image adhered on a transfer sheet to the surface of a receiving material so that the transferred image has a perfect shape without collapse.

Another object of the present invention is to provide an ink ribbon for producing the dry transfer material such that there is no residual ink remaining on the transfer sheet when the ink transfer image is transferred onto the surface of the receiving material by applying pressure to the back side of the transfer sheet.

It is another object of the present invention to provide an ink ribbon for producing dry transfer material such that the strength of resistance to scratches or scrapes on a surface of a transferred image will be greatly improved by improving the adherence between the transferred image and the surface of the receiving material to strongly adhere the transferred image to the receiving material.

It is another object of the present invention to provide an ink ribbon for producing dry transfer material capable of completing the transfer in a very short time by application of little pressure to the reverse side of the retransfer sheet.

To attain these and other objects, according to the invention, there is provided an image-transferable ink ribbon to be used for producing a dry type image-transfer material, the ink ribbon comprising: a ribbon substrate material and a layer formed on the ribbon substrate material, the layer including the dry type image-transfer material and a microcapsule encapsulated mold releasing agent.

As mentioned above, according to the invention thus structured, the mold releasing agent is contained in microcapsules in a layer placed on the film-like ribbon substrate. When such an ink ribbon is used to produce a transfer sheet, there is no residual ink left on the transfer sheet when the ink transfer image, printed using the thermo-sensitive transfer method on the transfer sheet, is pressure transferred onto the desired receiving material by the momentary application of the pressure from the reverse side of the retransfer sheet. Further, there is no collapse, spreading, and brittleness in the ink image which is pressure transferred. Therefore, an excellent image which is strongly adhered to the receiving material is obtained.

Moreover, the pressure transfer can be completed in a very short time by applying a pressure equivalent to a moderate pressure from the reverse side of the transfer sheet.

BRIEF DESCRIPTION OF THE DRAWINGS

A preferred embodiment of the present invention will be described in detail with reference to the following figures wherein:

FIGS. 4(A)and 4(B) are tables of a data showing a shelf life of the pressure-sensitive transferred image formed on a receiving material by the dry transfer material produced from the embodiments and that of the related art.

DETAILED DESCRIPTION OF THE PREFERRED EMBODIMENTS

FIG. is an expanded sectional view showing a first embodiment of an ink ribbon for producing dry transfer material.

Figure 1:
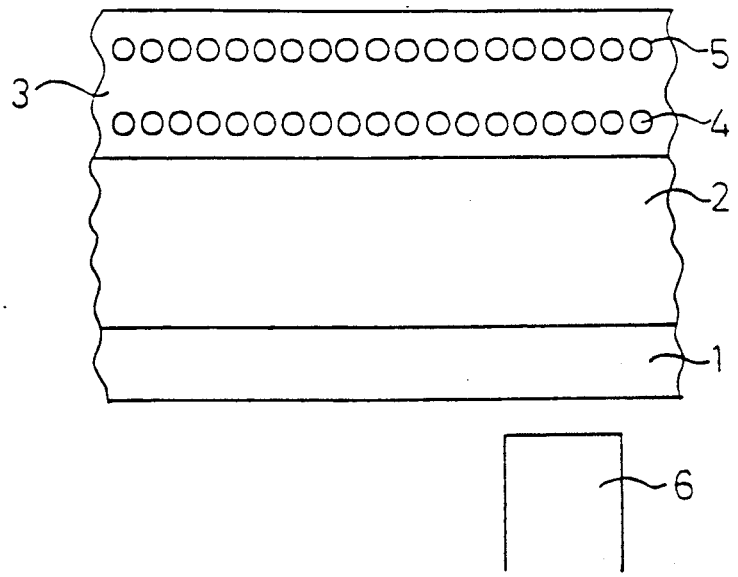
FIG. 1 is an expanded sectional view of an embodiment of an ink ribbon for producing dry transfer material.

As shown in FIG. 1, the ink ribbon for producing a dry transfer material is composed of a film-like ribbon substrate 1 with an ink layer 2 and a pressure-sensitive retransfer adjustment layer 3 provided thereon. The ink layer 2 contains a coloring agent and a pressure-sensitive adhesive component. The pressure-sensitive retransfer adjustment layer 3 includes microcapsules 5 containing a mold releasing agent 4 mixed in a thermo-sensitive adhesive component.

The ink ribbon is used with a printing device having a thermal head 6 of heat-generating elements (not shown), and has an electrical circuit such that only the heat-generating elements which correspond to characters or figures to be recorded on a transfer sheet are heated after the characters and figures have been defined by an operator using an input device.

The mold releasing agent 4 used in the present invention is not especially limited, however, a mold releasing agent having a good mold releasing property is preferred. That is, it is preferred that the mold releasing agent be either of a silicon oil, a fluorine resin, an olefin resin, a paraffin wax or another wax having comparable properties.

As the wall material of the microcapsules 5, that is ruptured by an external pressure, materials such as melamine-formaldehyde resin, urea-formaldehyde resin, gelatin, gum arabic, poly(vinyl alcohol), albumen, alginic acid salt, zein, casein, methylcellulose, carboxymethylcellulose, collagen, ethylene-maleic anhydride copolymers, vinyl methyl ether-maleic anhydride copolymers, urea-formalin resin, melamine-formalin resin, poly-urethane resin, and polyurea can be used.

It is desirable the diameter of each microcapsule 5 be in the range of 0.1 to 20 μm and, preferably, is in the range of 0.5 to 10 μm, in order to obtain an excellent transferred image on a receiving material using a pressure equivalent to a stamp pressure in the range of 50 $g/cm^2$–2000 $g/cm^2$. If the capsule diameter of the microcapsules 5 is less than 0.1 μm, the microcapsules 5 do not rupture easily and the lowest pressure necessary to rupture the microcapsule is increased greatly. On the other hand, if the diameter of the microcapsules 5 is more than 20 μm, the crisp transfer images of small characters or figures, for example, are not obtained. Therefore, the abovementioned pressure range is preferred.

The desirable coating thickness of the layer 3, containing the microcapsules 5, is in the range of 1 to 20 μm, preferably is in the range of 1 to 10 μm. If the coating thickness of the layer 3 is less than 1 μm, the releasibility necessary to obtain an excellent pressure-sensitive transfer is not obtained. On the other hand, if the coating thickness of the layer 3 is more than 20 μm, the transferred image may be bled by an excessive mold releasing agent and a sharp or crisp transferred image may not be obtained.

As the film-like ribbon substrate 1 for the ink ribbon, various materials may be used. Because the film-like ribbon substrate 1 is brought into contact with a thermal head for thermal transfer printing, the film-like ribbon substrate 1 preferably has a heat resistance of 150 degrees C. or higher. Thus, polyester films such as polyethylene terephthalate (PET) and polybutylene terephthalate, polyimide films, polycarbonate films, polysulfone films, polyethersulfone films, polyphenylene sulfide films, or papers such as condenser paper and glassine paper may be used. A desirable thickness of the film-like ribbon substrate 1 is in the range of 1–30 μm. In particular, the optimum thickness is in the range of 3 to 20 μm, in order to obtain an excellent transferred image by a pressure equivalent to a stamp pressure in the range of 50 $g/cm^2$–2000 $g/cm^2$. If the thickness of the film-like ribbon substrate is less than 1 μm, the ink ribbon is not smoothly transported in the printing device. On the other hand, if the thickness of the film-like ribbon substrate is more than 30 μm, sufficient heat from the heat generating elements of the thermal head 6 is not transmitted to the pressure-sensitive retransfer adjustment layer 3 and the ink layer 2, so that both the layer 3 and ink layer 2 are partially transferred onto the transfer sheet 7.

The ink layer 2 is mainly composed of a coloring agent, a thermo-sensitive adhesive component, and a pressure-sensitive adhesive component. Pigments such as carbon black are generally used as the coloring agent. However, if desired, dyes such as a leuco dye, to be colored by an acid, and a diazo dye, to be colored by a base, may be added to adjust the color tone of the ink, although the invention is not limited to the identified coloring agents.

As a coloring element of the leuco dye, to be colored by an acid, well-known materials such as phthalide compound, fluoran compound, lactone compound, triphenylmethane compound, rhodamine lactam compound, and quinone compound can be used. As a developer for making the leuco dye colored, phenol materials or acid materials are mainly used. The color reaction progresses based on the coloring element and the coloring temperature.

The diazo dye to be colored, by a base, is constructed by combining a diazo compound, which is an acid material, and a coupling compound which is basic dye-precursor. It is colored based on the contact of the materials while being heated.

The thermo-sensitive adhesive component of the pressure-sensitive retransfer adjustment layer 3 may be composed of one or more kinds of resin having high thermo-sensitive adhesiveness such as ethylene-vinyl acetate copolymer, poly(vinyl acetate), ionomer, acrylic polymer, ethylene-ethyl acetate copolymer, ethyleneacrylic acid copolymer, vinyl chloride-vinyl acetate copolymer, poly(vinyl butyral), poly(vinyl pyrrolidone), poly(vinyl alcohol), polyamide, and ethyl cellulose.

The pressure-sensitive adhesive component of the ink layer 2 may be composed of one or more kinds of material in combination selected from a group consisting of: vinyl polymers such as poly(vinyl chloride), poly(acrylic eater), ethylene-vinyl acetate copolymer, ethylene-ethyl acetate copolymer, poly(vinyl acetate), poly(vinyl ether), poly(vinyl acetal), and polyisobutylene; fibrous polymers such as ethyl cellulose, nitrocellulose, and cellulose acetate; and rubber(-like) polymers such as rubber chloride and natural rubber.

In addition, a tackifier, a binder agent and a surface modifier may also be contained in the thermo-sensitive adhesive and the pressure-sensitive adhesive components.

The tackifier acts to improve the adhesion and hardness of an ink, to give cohesion and tacking strength to the ink, and to give tackiness to the thermo-sensitive adhesive and the pressure-sensitive adhesive components. The tackifier may be composed of a mixture of one or more kinds of resin such as petroleum resin, rosin resin, ketone resin, polyamide resin, and phenolic resin.

The binder agent primarily used is one composed of waxes. The wax may be composed of one or more kinds of material selected from: plant waxes such as candelilla wax, carnauba wax, rice wax, and Japan wax; animal waxes such as bees waxes, lanolin, and whale waxes; mineral waxes such as montan waxes and ceresin; petroleum waxes such as paraffin wax, and microcrystalline wax. Also resin waxes such as $\alpha$-olefin-maleic anhydride copolymers may be used.

The surface modifier enables the ink ribbon to have an excellent shelf life, without one layer of ribbon sticking to another (blocking), and to have an excellent running property, without the meander and slipping caused by losing the tackiness on a surface of the ink ribbon thereby reducing the frictional resistance. As the surface modifier, well-known materials such as fluorine-contained polymer and silicone polymer may be used.

On the reverse side of the film-like ribbon substrate 1, to that on which the pressure-sensitive retransfer adjustment layer 3 and ink layer 2 are coated, may be placed an anti-sticking layer which may be composed of a heat-resistant resin such as silicon resin and pigments such as barium sulfate, titanium oxide, aluminum hydroxide, zinc oxide, calcium carbonate having a color corresponding to that of the film-like ribbon substrate.

Figure 2:
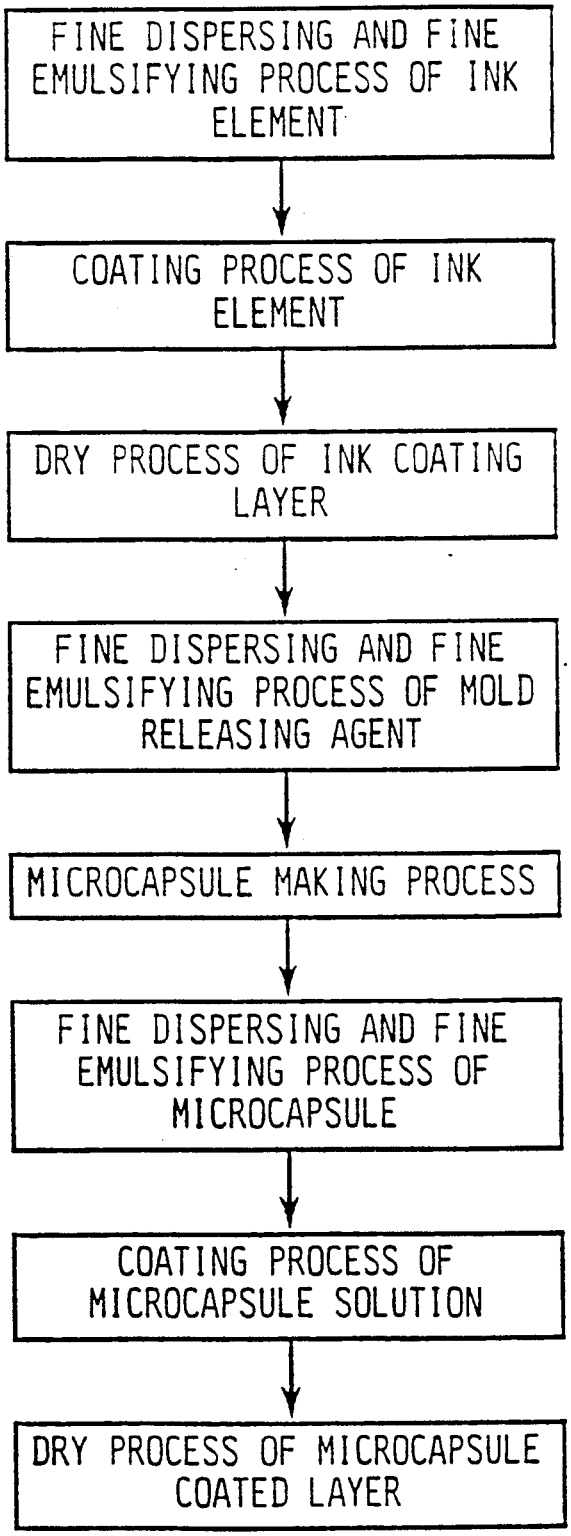
FIG. 2 is a block diagram showing a manufacturing process for the ink ribbon for producing dry transfer material.

A manufacturing process for an ink ribbon for producing dry transfer material will be explained with reference to FIG. 2.

First, a fine dispersing and fine emulsifying process of an ink element is performed. In this process, a coloring agent and a pressure-sensitive adhesive component are stirred and atomized, and a dispersant or a emulsifier are added thereto, and then a fine dispersing solution or an emulsifying solution, which uniformly contains the coloring agent and the pressure-sensitive adhesive component, is produced.

Then, the fine dispersing solution or the emulsifying solution containing the ink element is coated on a polyethylene terephthalate (PET) film-like ribbon substrate 1 by a well-known coating method, such as the bar coating method, the blade coating method, the air-knife coating method, the gravure coating method, the roll coating method, the spray coating method or the dip coating method.

Immediately after the ink element is coated on the film-like ribbon substrate in the above coating process, the ink element coated layer is heated and dried under atmospheric conditions at a temperature of 110°. As a result, an ink layer 2 is formed on the film-like ribbon substrate 1 by the above drying process.

Next, a fine dispersing and fine emulsifying process of the mold releasing agent is performed. In this process, a silicon oil mold releasing agent, melamine and formaldehyde are dissolved in an oil solvent and added, with stirring, to an aqueous solution. A dispersant or a emulsifier are added to the resultant solution to create a stable, finely dispersed solution or emulsion. The resulting finely dispersed solution or emulsion contains the silicon oil mold releasing agent.

Then a microcapsule making process is continuously performed. In this process, melamine-formaldehyde resin, which comprises the wall material of the microcapsules, is added, with stirring, to the finely dispersed solution or emulsion while heat is applied. As a result, a melamineformaldehyde resin is formed which forms the microcapsules containing the silicon oil mold releasing agent.

Next, the microcapsules are subjected to a fine dispersing and fine emulsifying process. In this process, the microcapsules 5 produced above, a thermo-sensitive adhesive component and a binder wax are dispersed or emulsified by stirring in an aqueous solution and a dispersant is added to stabilize the resultant fine dispersion or emulsion of the microcapsules.

The microcapsule solution is then coated on the ink layer 2 using a well-known coating method, such as the bar coating method, the blade coating method, the air-knife coating method, the gravure coating method, the roll coating method, the spray coating method or the dip coating method.

The film-like ribbon substrate on which the microcapsule solution has been coated is heated and dried under atmospheric conditions at a temperature of 110°. As a result, a pressure-sensitive retransfer adjustment layer 3 is formed on the ink layer 2. Thus, the ink layer 2 and the pressure-sensitive retransfer adjustment layer 3 are formed on the film-like ribbon substrate 1 as shown in FIG. 1. The ink layer 2 includes a coloring agent and a pressure-sensitive adhesive component and the pressure-sensitive retransfer adjustment layer 3 includes the microcapsules 5 containing the mold releasing agent 4 and the thermo-sensitive adhesive component.

Figure 3:
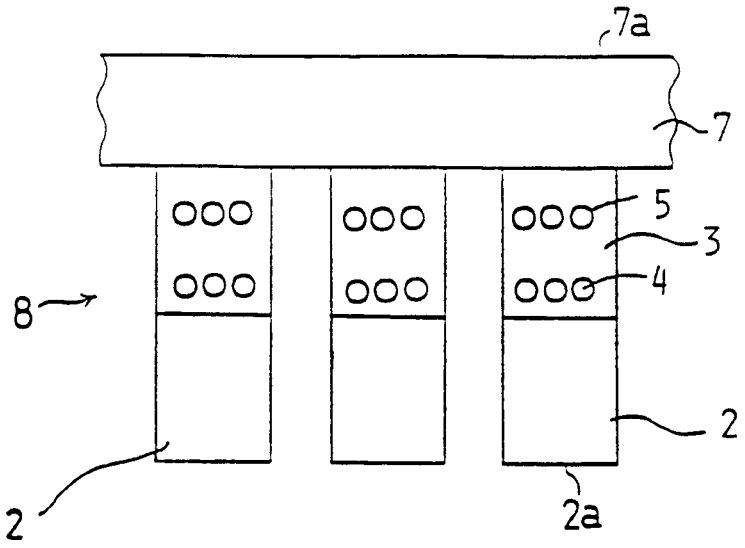
FIG. 3 is an expanded sectional view of a dry transfer sheet of the present embodiment.

FIG. 3 is an expanded sectional view of a dry transfer material made by using an ink ribbon for producing the dry transfer material of the present invention. The dry transfer material 8 is made by placing the pressure-sensitive retransfer adjustment layer 3, including the microcapsules 5 containing the mold releasing agent 4, and the ink layer 2 on the transfer sheet 7.

Next, the method for manufacturing the dry transfer material 8 is briefly explained.

First, a ribbon cartridge is assembled containing the ink ribbon of the invention. The ribbon cartridge is installed in a device for producing the dry transfer material (for example, Tape Printer "P-touch" manufactured by Brother industries, Ltd.) having a built-in thermal head 6.

Data to be recorded on the transfer sheet 7 is input and the head-generating elements of the thermal head 6, corresponding to characters or figures to be recorded, are heated to a temperature greater than the melting temperature of the pressure-sensitive retransfer adjustment layer 3 and an ink layer 2. Therefore, the transfer image is thermo-sensitively transferred from the ink ribbon onto the transfer sheet 7 to produce the dry transfer material 8 having the desired ink transfer images thereon.

When a side 2A of the dry transfer material 8 on which the ink transfer image is formed, is placed on the surface of a receiving material, and a pressure equivalent to the stamp pressure is applied to a side 7A of the dry transfer material 8, the microcapsules 5 are ruptured, and the silicon oil mold releasing agent contained therein flows out to reduce the adhesion between the pressure-sensitive retransfer adjustment layer 3 and the retransfer sheet 7 greatly. The result is a desirable transferred ink image that is pressure-sensitively transferred onto the receiving material, such as paper, plastic, metal, and wood. The transferred image has an excellent image quality without collapse, spreading, or brittleness. The stamp pressure necessary for pressure-sensitive transfer is set primarily according to the pressure which is necessary to rupture the microcapsules 5. The desirable stamp pressure, as previously noted, is in the range of 50 g/cm$^2$ to 2000 g/cm$^2$. In particular, the optimum stamp pressure in the range of 200 g/cm$^2$ to 1000 g/cm$^2$ in order to obtain an excellent transferred image without excessive effort. If the dry transfer material is such that the microcapsules 5 included therein may be ruptured with a stamp pressure of less than 50 g/cm$^2$, the microcapsule is too easily ruptured and the pressure-sensitive transfer is too easily performed. Therefore, the shelf life of the dry transfer material decreases as it is easily damaged. On the other hand, if the dry transfer material is such that the microcapsules 5 included therein are ruptured by a stamp pressure of more than 2000 g/cm$^2$, the microcapsules 5 are not easily ruptured and an excellent pressure-sensitive transferred image is not obtained.

Moreover, because the silicon oil mold releasing agent flows rapidly on rupture of the microcapsules 5, the adhesion between the pressure-sensitive retransfer adjustment layer 3 and the retransfer sheet 7 decreases rapidly and the pressure-sensitive transferred image can be transferred completely in a short time.

The results obtained by observing and comparing the shelf life of the transferred image made from the dry transfer material produced using the ink ribbon of the invention and that of a conventional transferred image are shown in FIGS. 4(A) and (B).

As the observation and a comparison method, the dry transfer material and the transferred image produced therefrom were visually observed after being left continuously under controlled atmospheric conditions at a temperature of 60 degrees C. and 85% relative humidity. The number of samples in one hundred examination samples in which bleedings, cracks and changes of hue were confirmed provided the measured result.

The conventional pressure-sensitive transfer image was obtained using a dry transfer material made from a conventional ink ribbon for producing dry transfer material which does not include the microcapsules containing the mold releasing agent therein.

In the invention, the pressure-sensitive retransfer adjustment layer containing the silicon oil mold releasing agent has excellent heatproof and water repellent characteristics. Therefore, in the image obtained from the dry transfer material, no cracks, bleedings and changes of hue were confirmed even after 480 to 720 hours had passed. However, with the conventional transferred image, bleedings, cracks and/or changes of hue result before 240 hours have passed and their numbers increase with the passage of time. Therefore, it was found that the shelf life of the conventional transferred image was deteriorated.

While the invention has been described in detail and with reference to specific embodiments thereof, it will be apparent to one skilled in the art that various changes and modifications can be made therein without departing from the spirit and scope of the invention.

What is claimed is:

1. An image-transferring ribbon to be used for producing a dry image-transferring material comprising:

a ribbon substrate material; and a layer formed on said ribbon substrate material, said layer including a dry image-transfer material and a microcapsule encased mole releasing agent.

2. The image-transferable ribbon as defined in claim 1, wherein said layer includes a retransfer adjustment layer formed on said ribbon adjustment layer including said microcapsule encased mode releasing agent.

3. The image-transferable ribbon as defined in claim 1, wherein the diameter of each said microcapsule is 0.1–20 micrometers.

4. The image-transferable ribbon as defined in claim 1, wherein the outside wall of each said microcapsule is formed to be ruptured by the force of 50 g/cm$^2$–2000 g/cm$^2$.

5. The image-transferable ribbon as defined in claim 2, wherein said retransfer adjustment layer containing said microcapsule encased mold releasing agent is 1–20 micrometers thick.

6. The image-transferable ribbon as defined in claim 1, wherein the material forming an outside wall of each said microcapsule comprises one of a group of materials consisting of melamine-formaldehyde resin, urea-formaldehyde resin, gelatin, gum arabic, poly(vinyl alcohol), albumen, alginic acid salt, zein, casein, methylcellulose, carboxymethylcellulose, collagen, ethylene-maleic anhydride copolymers, vinyl methyl ether-maleic anhydride copolymers, urea-formalin resin, melamine-formalin resin, polyurethane resin, and polyurea.

7. The image-transferable ribbon as defined in claim wherein said mold releasing agent comprises a material having excellent heat resistant and waterproof characteristics.

8. An ink ribbon for producing dry transfer materials, comprising:

a ribbon substrate;

an ink layer adhered to said ribbon substrate, and a release layer adhered over said ink layer, said release layer containing a microcapsule encased mold releasing agent.

9. The ink-ribbon as claimed in claim 8, wherein said ink layer contains a pressure-sensitive adhesive component in addition to a coloring agent.

10. The ink ribbon as claimed in claim 8, wherein a diameter of each said microcapsule is in a range of 0.1 to 20 micrometers.

11. The ink ribbon as claimed in claim 10, wherein the range of said diameter is 0.5 to 10 micrometers.

12. The ink ribbon as claimed in claim 8, wherein said release layer is 1 to 20 micrometers thick.

13. The ink ribbon as claimed in claim 12, wherein said release layer is 1 to 10 micrometers thick.

14. The ink ribbon as claimed in claim 8, wherein each said microcapsule ruptures under a pressure in a range of 50–2000 g/cm$^2$.

15. The ink ribbon as claimed in claim 14, wherein said range where each said microcapsule ruptures is 200–1000 g/cm$^2$.

* * * * *